US006174426B1

(12) United States Patent
Osanaiye

(10) Patent No.: US 6,174,426 B1
(45) Date of Patent: Jan. 16, 2001

(54) TIN-PLATED STEEL WITH ADHESION PROMOTER

(75) Inventor: Gabriel Jeminiwa Osanaiye, Monroeville, PA (US)

(73) Assignee: USX Corporation, Pittsburgh, PA (US)

( * ) Notice: Under 35 U.S.C. 154(b), the term of this patent shall be extended for 0 days.

(21) Appl. No.: 09/373,393

(22) Filed: Aug. 12, 1999

(51) Int. Cl.[7] ..... C25D 7/06; C25D 5/36; C25D 5/50; C23C 28/00

(52) U.S. Cl. ..... 205/140; 205/142; 205/154; 205/156; 205/194; 205/196; 205/197; 205/217; 205/218; 205/226

(58) Field of Search ..... 205/140, 142, 205/154, 156, 194, 196, 197, 217, 218, 226

(56) References Cited

U.S. PATENT DOCUMENTS

| | | | | |
|---|---|---|---|---|
| 2,974,091 | | 3/1961 | Neish | 204/37 |
| 3,138,548 | | 6/1964 | Ham et al. | 204/32 |
| 3,227,637 | | 1/1966 | DeHart | 204/38 |
| 3,245,577 | | 4/1966 | Virzi | 220/64 |
| 3,322,656 | | 5/1967 | Dahringer et al. | 204/38 |
| 3,826,675 | | 7/1974 | Smith et al. | 117/75 |
| 3,915,812 | | 10/1975 | Yamagishi et al. | 204/34 |
| 4,104,419 | * | 8/1978 | Tanikawa et al. | 427/46 |
| 4,228,221 | | 10/1980 | Rohowitz | 428/469 |
| 4,285,783 | | 8/1981 | Giza et al. | 204/35 N |
| 4,388,158 | | 6/1983 | Inui et al. | 204/27 |
| 4,402,747 | | 9/1983 | Bird et al. | 106/14.42 |
| 4,487,663 | | 12/1984 | Hara et al. | 204/127 |
| 4,812,365 | | 3/1989 | Saunders et al. | 428/469 |
| 5,084,358 | * | 1/1992 | Saunders | 428/469 |
| 5,248,405 | | 9/1993 | Kaneda et al. | 205/154 |
| 5,753,779 | | 5/1998 | Verberg | 525/369 |

FOREIGN PATENT DOCUMENTS

| | | |
|---|---|---|
| 2696371 A | 10/1992 | (FR) . |
| 53-084037 | 7/1978 | (JP) . |

* cited by examiner

*Primary Examiner*—Edna Wong
(74) *Attorney, Agent, or Firm*—W. F. Riesmeyer, III

(57) ABSTRACT

A method is provided for enhancing the adhesion of organic polymer coatings to electrolytically passivated (CDC) tin-plated steel strip. The method includes applying a solution comprising 0.1 to 7 percent of an adhesion promoter to the electrolytically tin-plated strip during the processing of the strip on an electrolytic tin-plating line. The adhesion promoter may be at least one selected from the group consisting of:

(a)

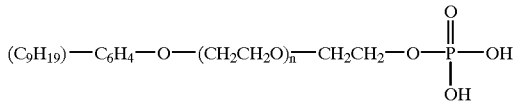

where n is within a range of from 4 to 99;

(b) $C_{16}H_{33}+N(CH_3)_3$ M where M is member of the halogen group; and (c) $R_n—Si—(X)_{4-n}$ where R is a non-hydrolyzable organic radical selected from the group consisting of glycol, epoxy, amine, diamine or mercapto groups, and mixtures thereof, containing from 3 to 10 carbon atoms; the number n is an integer from 1 to 3; and X is a hydrolyzable group selected from the group consisting of Cl—, $OCH_3$, $OCH_2CH_5$, $OOCCH_3$, $OCH_2OCH_3$, amine, diamine, triamine, acyloxy and alkoxysilanes, and mixtures thereof.

7 Claims, No Drawings

TIN-PLATED STEEL WITH ADHESION PROMOTER

TECHNICAL FIELD

The present invention is of a method for the production of flow brightened and chemically passivated electrolytically tin-plated steel with an enhanced lacquer adhesion characteristic, and particularly to a method for the production of such steel by the application of an adhesion promoter to the tin-plated steel surface during production of the steel on an electrolytic tin-plating line.

BACKGROUND ART

In the production of tin-plated steel for food and beverage cans the steel is plated with tin on an electrolytic tin-plating line. The tin-plate coating is generally melted or "reflowed" and quenched to produce a bright and shiny appearance. As a result of reflowing, a film of tin oxide develops on the surface of the tin-plate. If the growth of this oxide is not stopped or inhibited, it can lead to discoloration when the steel is used for packing certain products. To inhibit oxide growth, the reflowed strip is subjected to a cathodic dichromate treatment in subsequent sequential sections of the electrolytic plating line to passivate the tin-plate surface. After this passivation, a thin film of synthetic oil is electrostatically applied uniformly on the surface before shipment to customers for lacquering with an organic coating. The lacquer may or may not include an adhesion promoter to cause the lacquer to adhere to the dichromate treated surface of the tin-plate. Can manufacturers have experienced sporadic occurrences of poor adhesion of certain epoxy phenolic lacquers despite the inclusion of adhesion promoters in the lacquer. Historically the adhesion problem has been linked to the presence of tin oxide that forms on the surface of the tin-plate and which continues to grow slowly in storage as mentioned above. Varying the solution concentration, temperature, pH, current and current density of the cathodic dichromate treatment as well as the line speed of the strip through the treatment tank has not solved the problem of sporadic poor lacquer adhesion on tin-plate product. It has been further suggested that the adhesion problem could be due to additional tin and chromium oxides that rapidly develop during the lacquer baking cycle. The thermally induced tin oxide is thought to be weak and fragile. However, it has not been possible to fully determine the nature of these oxides and differentiate the thermally induced oxides from the more stable forms. Differences in the formulation of the epoxy phenolic lacquers used by various can manufacturers are also thought to be one cause of the problem. For example, several epoxy phenolic lacquers commonly used for food cans have been found to exhibit differing degrees of sensitivity to variations in the cathodic dichromate treated tin-plate surface. There are many factors that effect the degree of sensitivity of the lacquer to the surface of the tinplate, such as the molecular weight of binders contained in the lacquer, the ratio of different binders in the lacquer, and other factors that appear as numerous as the number of lacquer formulations. To date efforts to solve the adhesion problem have not been successful U.S. Pat. No. 5,753,779 to Verberg, discloses an aqueous chromium-free coating for treatment, particularly the pretreatment, of metal packaging for the foodstuffs industry, for example tin-plate and aluminum. The coating comprises acrylic acid or a derivative and a crosslinking system comprising at least one hydroxide of a divalent metal and an amine compound. The acrylic acid or derivative and the crosslinking system are used in a ratio of 1.5–4 to 2–4. Preferably the acrylic acid derivative is an acidic resin which comprises 2–8% of the coating solution. The coating solution is applied to a degreased substrate that has been freed of oxide such that the layer has a weight of 25–4000 milligrams per square meter after drying. The coating is safer to use on health grounds than chromium conversion coatings and has comparable properties such as lacquer adhesion.

U.S. Pat. No. 4,104,419 to Tanikawa et al, discloses a method for producing electrolytic tin-plate that is free from discoloration (yellow stain) and having an improved soldering, paint adhesion, resistance to smudges, eye-holeing, and corrosion by sulfides. The electrolytically tin-plated steel is treated with an aqueous solution consisting essentially of 0.1 to 10% of a pyrazole derivative, after which the steel is dried and the tin-plate coating is reflowed and subjected to a conventional chromate treatment. The aqueous solution may also contain 0.1 to 10% of a colloidal substance selected from the group consisting of silica sol and alumina sol.

U.S. Pat. No. 3,138,548 to Ham et al, discloses a method of treating electrolytic tin-plate to improve its lacquer adherent properties. The reference discloses subjecting a tin-plate surface after fusion to treatment by a combination of steps which include: a cathodic treatment in an alkaline electrolyte, a water rinse, a dilute acid dip to bring the surface of the plate to about pH 4–6, and a cathodic chromate treatment in an acidic electrolyte having a pH of about 4–6.

U.S. Pat. No. 3,826,675 to Smith et al, discloses metallic container stock such as tin-plate having a citric acid ester lubricant applied to its surface and which is characterized by excellent wettability and adhesion of organic coatings, especially epoxy resin coating compositions. Preferred citric acid ester lubricants disclosed are triethyl citrate, acetyl triethyl citrate, tributyl citrate, acetyl tributyl citrate, acetyl tri-2-ethylhexyl citrate and mixtures of them. The lubricant is applied to the tin-plated steel strip after flow brightening, quenching and a cathodic dichromate treatment.

U.S. Pat. No. 2,974,091 to Neish, discloses a method of treatment of tin-plate to minimize or eliminate the tendency to "eye-holing" i.e. portions leaving bare spots when lacquered. The steel strip is cleaned, pickled, plated with tin, heated to brighten the deposited tin coating and quenched by a water spray. It is then passed through a stabilizing bath where it is subjected to treatment for the formation of a protective film containing chromium compounds by electrolysis in a solution containing hexavalent chromium. After that the strip is passed through a water rinse and then through a spray or bath of an acidic reducing solution such as a dilute aqueous solution of citric acid or stannous chloride to reduce any free hexavalent chromium to trivalent chromium thereby reducing the tendency to eye-holing on lacquering.

An abstract of Japanese Kokai, JP53084037, assigned to Toyo Ink Manufacturing Company, discloses coating tin-plate with a thin film of metal alcoholate and/or its chelate compound to improve the adherence of ultraviolet curable ink compositions to the tin-plate.

U.S. Pat. No. 4,228,221 to Rohowetz, discloses a method of increasing adhesion of inks and coatings on metal surfaces. The method includes a treatment of the lubricated metal substrate with an organic titanate such as tetrakis (2-ethyl hexyl) titanate and then exposing the surface to ultraviolet light to accelerate the reaction of the titanate with the metal surface.

An abstract of French Patent, FR 2696371, assigned to Ateliers Reunis Caddie SA, discloses applying a varnish underlayer to electrolytic zinc-plated metal to improve the bonding of epoxy resin outer coatings.

U.S. Pat. No. 4,388,158 to Inui et al, discloses steel sheet having an extremely thin tin layer or an extremely thin iron-tin alloy layer having excellent bonding strength after aging in hot water, without deterioration of the bonding strength of organic adhesives. The steel is produced by passing the steel through an acid electrolyte, such as stannous phenolsulfonate or stannous sulfate, to which at least one sulfate selected from the group of sulfates of alkaline metals, ammonium, aluminum, manganese and chromium has been added.

U.S. Pat. No. 4,285,783 to Giza et al, discloses a plastic coating for metal shelving to which an epoxy resin is applied. The metal is plated with a nickel film and a chromium film, which is then treated with an iron phosphate in order to enhance the adhesion of the final outer layer of plastic.

U.S. Pat. No. 3,915,812 to Yamagishi et al, discloses a method for the cathodic treatment of steel strip prior to electrolytic tin-plating to enhance its corrosion resistance. The treating bath comprises an aqueous solution containing from 1 to 10 g/l of caustic soda or sodium orthosilicate and from 5 to 50 g/l of one or more of water soluble oxyacids such as citric acid, gluconic acid, water soluble salts of the oxyacids, a chelating agent having a chelating capability in an alkaline region or an aqueous solution containing from 1 to 10 g/l of sulfuric acid and from 5 to 50 g/l of glucocinic acid, water soluble salts of gluconic acid or a mixture thereof.

U.S. Pat. No. 4,402,747 to Bird et al, discloses a rust inhibiting coating for steel comprising dioctyl sebacate, sodium benzoate and certain sarcosine surfactants.

A literature paper by Barry Arkles entitled "Tailoring Surfaces with Silanes" published by CHEMTEC, December 1977, pages 766–778 discloses organosilanes for altering the wetting or adhesion characteristics of substrates. The reference teaches that organosilanes include $R_n$ nonhydrolyzable organic radical(s) and $X_{4-n}$ hydrolyzable group(s). The nonhydrolyzble group(s) typically are said to be halogen, alkoxy, acyloxy, or amine. Following hydrolysis, a reactive silanol group is formed, which can condense with other silanol groups, for example, those on the surface of siliceous fillers to form siloxane linkages. Stable condensation products are also formed with other oxides such as those of aluminum, zirconium, tin, titanium and nickel. Less stable bonds are said to be formed with oxides of boron, iron, and carbon. The reference discloses that one can form covalent bonds between an organic moiety and a substrate through an intermediary functional silane, called a coupling agent. Coupling agents are said to be used in enzyme immobilization, solid state synthesis, as antimicrobial agents and dye-fixing agents in textiles, organic surface coatings, and polymer composites and bulk interfaces. The reference states in most cases the substrate is pretreated with the silane-coupling agent, but integral blending accomplished by simple mixing of all the reactants at once, particularly for coatings and composites, is frequently used. The reference does not teach or suggest that the addition of organosilanes to the surface of electrolytic tin-plated steel before, during or after chromate treatment would eliminate poor adhesion of lacquers containing adhesion promoters subsequently applied to the surface.

Various other miscellaneous references are as follows: U.S. Pat. Nos. 3,245,577: 3,227,637; 3,322,656; 4,487,663; 4,812,365; 5,084,358; and 5,248,405.

DISCLOSURE OF INVENTION

According to this invention a method is provided for enhancing the adhesion of organic polymer lacquers to the surface of electrolytically tin-plated steel strip, especially for enhancing the adhesion of such lacquers to flow brightened and chromate treated, particularly cathodic dichromate (CDC) treated, tin-plated steel strip. The method includes electrolytically tin-plating steel strip on an electrolytic tin-plating line, and applying an adhesion promoter to a surface of the strip during production of the tin-plated strip on said line prior shipment to a customer who applies the organic lacquer at a later date. The method is especially useful for enhancing the adhesion of organic polymer lacquers that are particularly sensitive to the condition of the surface of the flow brightened and CDC passivated tin-plated steel strip. The sensitivity of certain types of lacquers to CDC passivated tinplate increases as the ratio of phenolic to epoxy molecules increases. Adhesion of such lacquers to CDC passivated tinplate also tends to fail as the molecular weight of the lacquer increases. Examples of such organic polymer lacquers are epoxy phenolic. Others are acrylic, polyester, urea, vinyl and others that tend to fail to adhere to the surface of such strip.

The adhesion promoter may be at least one selected from the group consisting of:

(a)

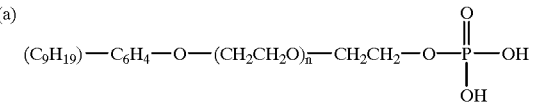

where n is within a range of from 4 to 99;

(b) $C_{16}H_{33}N(CH_3)_3$ M where M is member of the halogen group; and (c) $R_n$—Si—$(X)_{4-n}$ where R is a non-hydrolyzable organic radical selected from the group consisting of glycol, epoxy, amine, diamine or mercapto groups, and mixtures thereof, containing from 3 to 10 carbon atoms; the number n is an integer from 1 to 3; and X is a hydrolyzable group selected from the group consisting of Cl—, $OCH_3$, $OCH_2CH_5$, $OOCCH_3$, $OCH_2OCH_3$, amine, diamine, triamine, acyloxy and alkoxysilanes, and mixtures thereof.

The adhesion promoter may be added in either organic or aqueous solution in an effective concentration of the adhesion promoter within the range of 0.1 to 7.0%, and preferably the solution has a pH within the range of about 4.0 to about 6.0. The solution may be applied at one or more of several locations on the electrolytic tin-plating line. The adhesion promoter may be added to the quench water for quenching the strip after reflowing or in a separate treatment, for example, by dipping in a treatment tank after quenching. Alternatively, the adhesion promoter may be added to the cathodic dichromate treatment solution or to the post cathodic dichromate rinse water, or it may be added in a separate treatment, for example, by dipping in a treatment tank after rinsing. The oil soluble form of the organic adhesion promoter may be applied in organic solution, for example, by adding it to the oil lubricant applied using, for example, an electrostatic oiler on the electrolytic tin-plating line.

MODES FOR CARRYING OUT THE INVENTION

The electrolytic tin-plating of steel strip for food and beverage can applications typically is performed on an electrolytic tin-plating line, which may include, in sequence, a cleaning section, a rinsing unit, a pickling section, a second rinsing unit, a tin-plating section, a third rinsing unit, a flow brightening or fusion section, a quench tank, a chemical treating unit, for example, for cathodic dichromate treatment of the strip, a fourth rinsing unit, and an oiling unit. After shipment to the customer, the strip is coated with a lacquer before fabrication into food and beverage cans. The lacquer serves to prevent bleaching of highly colored fruits and sulphide staining caused by sulphur-bearing foods.

According to this invention a thin, preferably less than 1 micron thick, adhesion promoter coating is applied to the surface of the strip on the electrolytic tin-plating line. The strip is subjected to treatment in an aqueous or organic solution containing an effective concentration of 0.1 to 7% of the adhesion promoter, where the adhesion promoter is at least one selected from the group consisting of:

(a)

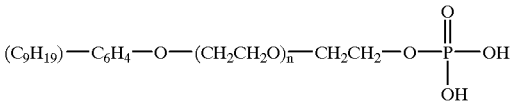

where n is within a range of from 4 to 99;

(b) $C_{16}H_{33}N(CH_3)_3$ M where M is member of the halogen group; and (c) R—Si—$(X)_{4-n}$ where R is a non-hydrolyzable organic radical selected from the group consisting of glycol, epoxy, amine, diamine or mercapto groups, and mixtures thereof, containing from 3 to 10 carbon atoms; the number n is an integer from 1 to 3; and X is a hydrolyzable group selected from the group consisting of Cl—, $OCH_3$, $OCH_2CH_5$, $OOCCH_3$, $OCH_2OCH_3$, amine, diamine, triamine, acyloxy and alkoxysilanes, and mixtures thereof.

The adhesion promoter preferably is applied as an organic solution, for example, by adding it to the oil applied in the lubricant section of the line after the chromate treatment. The adhesion promoter may also be applied as an aqueous solution, for example, by adding it to the water for quenching the reflowed coating at the exit end of the fusion unit or as a separate treatment by spraying or dipping after quenching. It may also be added to the dichromate solution in the chemical treatment section of the line, to water used in the rinsing unit at the exit end of the chemical treatment section, or as a separate treatment, by dipping or spraying after the rinse following the chromate treatment. The strip is preferably subjected to the treatment so as to form a coating weight up to 0.5 milligrams per square meter, most preferably within the range of 0.0015 to 0.4 milligrams per square meter. Preferably, the pH of the solution should be regulated to be within a range of 4.0 to 6.0 with 5.0 being most preferred. The pH may be regulated using a mild or weak organic acid like acetic acid when necessary. Excessive or inadequate pH may retard, prevent or reverse the formation of necessary intermediate silanols on tin-plate.

The following trials were conducted to show the effect of providing a coating of adhesion promoters on the surface of tin-plated steel and allowed to age for four weeks prior to lacquer coating. The lacquers tested on the CDC treated surface were known to be sensitive to such surface. The adhesion promoters used are listed in Table 1 below:

TABLE 1

| Number | Manufacturer | Product Name or Designation | Chemical Formula or Name |
|---|---|---|---|
| 1 | Huls America, Theodore, AL | Hydrosyl 2627 | oligomeric siloxane |
| 2 | Huls America, Theodore, AL | Hydosyl 2759 | aqueous epoxy functional silane |
| 3 | Rhone-Poulenc, Cranbury, NJ | Rhodafact RE-410 | polyoxyethylene nonphenylether phosphate |
| 4 | Rhone-Poulenc, Cranbury, NJ | RhodaQuat M242C/29 | $C_{16}H_{33}N(CH_3)_3Cl$ |
| 5 | Osi Specialties Inc., a Witco Group Company, Friendly, WV | Siliquest A-1100 | gamma aminopropy triethoxysilane |
| 6 | Osi Specialties Inc., a Witco Group Company, Friendly, WV | Siliquest A-189 | gamma mercaptopropyl trimethoxysilan |
| 7 | Osi Specialties Inc., a Witco Group Company, Friendly, WV | Siliquest A-186 | beta-(3,4-epoxycyclohexyl) ethyltrimethoxys lane |
| 8 | Sivento, a Huls Group Company, Somerset, NJ | Dynasylan Glymo | trimethoxy(3-(Oxyranylmethox propyl)-silane |
| 9 | Sivento, a Huls Group Company, Somerset, NJ | Dynasylan Ameo | 3-Aminopropyl triethoxy sila |

EXAMPLE 1

Five adhesion promoters, each at three concentration levels in aqueous solution were applied to tin-plated strip on a research pilot line by immersion in a tank at a location downstream of the cathodic dichromate treatment and rinse tanks. The lacquer adhesion performance of two lacquers was evaluated on samples of the strip. The adhesion rating was determined according to standard ASTM 3359 dry and wet adhesion tests. The results in Table 2 (for lacquer A) and Table 3 (for lacquer B) show that the promoters significantly improved the adhesion performance of these lacquers on tin-plate. The control samples were obtained by reversing the current of the cathodic treatment to anodic. The anodically treated material is generally known for poor adhesion performance with phenolic and epoxy phenolic lacquers. Such anodically treated tin-plate generally fails the adhesion test when coated with epoxy phenolic lacquer.

TABLE 2

Lacquer Adhesion Test
Lacquer A
(Dry/Wet)*

| Adhesion Promoter | Chromate Treatment | 1.0% Solution | 2.5% Solution | 3.5% Solution |
|---|---|---|---|---|
| 1 | Anodic | 0/0 | 0/0 | 0/0 |
| 1 | Cathodic | 0/0 | 5/0 | 0/5 |
| 2 | Anodic | 0/0 | 5/5 | 0/0 |
| 2 | Cathodic | 5/5 | 0/0 | 5/0 |
| | | 0.3% Solution | 0.5% Solution | 0.7% Solution |
| 3 | Anodic | 5/5 | 0/0 | 0/0 |
| 3 | Cathodic | 5/5 | 5/5 | 5/5 |
| 4 | Anodic | 0/0 | 5/5 | 0/0 |
| 4 | Cathodic | 5/5 | 0/0 | 5/5 |

TABLE 2-continued

Lacquer Adhesion Test
Lacquer A
(Dry/Wet)*

*ASTM 3359 Dry and Wet Adhesion Tests.
Rating 5 is good and 0 is bad.

TABLE 3

Lacquer Adhesion Test
Lacquer B
(Dry/Wet)*

| Adhesion Promoter | Chromate Treatment | 1.0% Solution | 2.5% Solution | 3.5% Solution |
|---|---|---|---|---|
| 1 | Anodic | 0/0 | 0/0 | 0/0 |
| 1 | Cathodic | 0/5 | 0/0 | 0/0 |
| 2 | Anodic | 0/0 | 5/5 | 0/0 |
| 2 | Cathodic | 5/5 | 0/0 | 5/5 |
| | | 0.3% Solution | 0.5% Solution | 0.7% Solution |
| 3 | Anodic | 5/5 | 0/0 | 0/0 |
| 3 | Cathodic | 0/5 | 5/5 | 5/5 |
| 4 | Anodic | 0/0 | 5/5 | 0/0 |
| 4 | Cathodic | 5/5 | 0/0 | 5/5 |

*ASTM 3359 Dry and Wet Adhesion Tests
Rating 5 is good and 0 is bad.

A second series of trials were conducted on a research pilot electrolytic tin-plating line. Seven adhesion promoters were added in aqueous solutions at the same location (after cathodic dichromate treatment and quench) as in the first series of trials. The percentage of promoter concentration was reduced to further investigate the range of effectiveness of solution concentration. Addition at a location after reflow and quench before dichromate treatment was included in these trials. As in the first series of trials some samples were treated with cathodic current during dichromate treatment and others with anodic current. Samples were also included which were dichromate treated without addition of promoter for control purposes in the second series of trials. Tables 4 and 5 show the results for addition of promoter after dichromate treatment and rinse for lacquers A and B, respectively. Table 6 shows the results for addition of promoter after reflow and quench before dichromate treatment for lacquers A and B and control samples with no promoter addition.

TABLE 4

Lacquer Adhesion Test Results
Lacquer A
(Dry/Wet)*

| Adhesion Promoter | Chromate Treatment | Solution Concentration 0% | 0.5% | 1% | 1.5% |
|---|---|---|---|---|---|
| 1 | Anodic | | 0/0 | 0/0 | 0/0 |
| 1 | Cathodic | 0 | 2/2 | 0/0 | 4/4 |
| 2 | Anodic | | 0/0 | 0/0 | 0/0 |
| 2 | Cathodic | 0 | 1/1 | 4/5 | 5/4 |
| 4 | Anodic | | 0/0 | 0/0 | 0/0 |
| 4 | Cathodic | 0 | 2/4 | 4/4 | 4/4 |

TABLE 4-continued

Lacquer Adhesion Test Results
Lacquer A
(Dry/Wet)*

| | | Solution Concentration 0% | 0.1% | 0.3% | 0.5% |
|---|---|---|---|---|---|
| 3 | Anodic | | 0/0 | 0/0 | 0/0 |
| 3 | Cathodic | 0 | 2/5 | 2/4 | 4/5 |
| 5 | Anodic | | 0/0 | 0/0 | 0/0 |
| 5 | Cathodic | 0 | 4/4 | 5/4 | |
| 6 | Anodic | | 0/0 | 0/0 | 0/0 |
| 6 | Cathodic | 0 | 5/— | 5/5 | 5/5 |

*ASTM Dry and Wet Adhesion Tests
Rating 5 is good and 0 is bad

TABLE 5

Lacquer Adhesion Test Results
Lacquer B
(Dry/Wet)*

| Adhesion Promoter | Chromate Treatment | Solution Concentration 0% | 0.5% | 1% | 1.5% |
|---|---|---|---|---|---|
| 1 | Anodic | | 0/0 | 0/0 | 0/0 |
| 1 | Cathodic | 0 | 5/5 | 5/5 | 5/4 |
| 2 | Anodic | | 0/0 | 0/0 | 0/0 |
| 2 | Cathodic | 0 | 5/4 | 5/5 | 5/5 |
| 4 | Anodic | | 0/0 | 0/0 | 0/0 |
| 4 | Cathodic | 0 | 5/5 | 5/5 | 5/5 |
| | | Solution Concentration 0% | 0.1% | 0.3% | 0.5% |
| 3 | Anodic | | 0/0 | 0/0 | 0/0 |
| 3 | Cathodic | 0 | 4/5 | 5/5 | 5/5 |
| 5 | Anodic | | 0/0 | 0/0 | 0/0 |
| 5 | Cathodic | 0 | 5/4 | 5/5 | 5/5 |
| 6 | Anodic | | 0/0 | 0/0 | 0/0 |
| 6 | Cathodic | 0 | 5/5 | 5/5 | 5/5 |

*ASTM 3359 Dry and Wet Adhesion Tests
A rating of 5 is good and 0 is bad.

TABLE 6

Adhesion Promoter Test Results Of
Application After Reflow and Quench Before Cathodic
Dichromate Treatment
(Dry/Wet)*

| Adhesion promoter | Lacquer | Solution Concentration 0%** | 0.75% |
|---|---|---|---|
| 1 | A | | 5/5 |
| 1 | B | | 5/4 |
| None | None | 0/— | |
| 2 | A | | 5/5 |
| 2 | B | | 3/5 |
| None | None | 0/— | |
| | | Solution Concentration 0%** | 0.25% |
| 3 | A | | 5/5 |
| 3 | B | | 3/4 |
| None | None | 0/— | |
| 4 | A | | 5/4 |
| 4 | B | | 4/4 |

TABLE 6-continued

| Adhesion Promoter Test Results Of Application After Reflow and Quench Before Cathodic Dichromate Treatment (Dry/Wet)* | | | |
|---|---|---|---|
| None | None | 0/— | |
| 5 | A | | 5/5 |
| 5 | B | | 5/5 |
| None | None | 0/— | |
| 6 | A | | 5/5 |
| 6 | B | | 5/4 |
| None | None | 0/— | |

*ASTM 3359 Dry and Wet Adhesion Tests
Rating 5 is good and 0 is bad.
**No organosilane in solution
***Dry test only Table 5 shows that significant improvement in adhesion of lacquer A was achieved for adhesion promoters 1, 2 and 4 at solution concentrations 0.5, 1 and 1.5%. The results in Table 4 for lacquer B show that adhesion promoters 5 and 6 provided good adhesion test results at all concentrations tested. Promoters 1–4 produced variable results but generally improved lacquer adhesion at the higher concentrations. Table 6 shows application of the adhesion promoters after reflow and quench is effective for increasing lacquer adhesion at even lower concentration levels than application after cathodic dichromate treatment. Thus, through selection of the proper adhesion promoter, and application of the promoter directly to electrolytic tin-plated steel strip, significant improvement in lacquer adhesion can be achieved.

Tests were also run on a pilot line by adding adhesion promoters to the lubricant oil and applying the lubricant oil containing the adhesion promoter to the CDC passivated tinplated strip. Four adhesion promoters were used in these tests. The lubricant oil was acetyl tributyl citrate (ATBC). The results are shown in Table 7 below. Application of the adhesion promoter in the lubricant oil produced good adhesion of CDC sensitive lacquers on all tests.

TABLE 7

| Test Results of Addition Of Adhesion Promoter In ATBC Lubricant Oil (Dry/Wet)* | | | |
|---|---|---|---|
| Adhesion Promoter | Lacquer | % Adhesion Promoter in ATBC or Oil | Adhesion Rating |
| 5 | A | 1 | 5/5 |
| 5 | B | 1 | 5/5 |
| 7 | A | 1 | 5/5 |
| 7 | B | 1 | 5/5 |
| 8 | A | 1 | 5/5 |
| 8 | B | 1 | 5/5 |
| 9 | A | 1 | 5/5 |
| 9 | B | 1 | 5/5 |

*ASTM Dry and Wet Adhesion Tests
Rating 5 is good and 0 is bad.

What is claimed is:

1. A method for enhancing the adhesion of a polymer lacquer coating to electrolytically tin-plated steel strip, comprising:

(a) continuously passing said steel strip through an electrolyte bath on a strip processing line and applying an electric current to said bath to provide a tin-plate coating on the strip, and applying a solution containing an effective concentration of 0.1 to 7 percent of an adhesion promoter to said tin-plated steel strip during processing of said strip on said strip processing line to provide an adhesion promoter coating thereon, said adhesion promoter being at least one selected from the group consisting of:

(a)

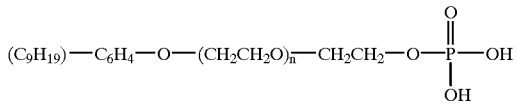

where n is within a range of from 4 to 99;

(b) $C_{16}H_{33}N(CH_3)_3$ M where M is a member of the halogen group; and (c) $R_n$—Si—$(X)_{4-n}$ where R is a non-hydrolyzable organic radical selected from the group consisting of glycol, epoxy, amine, diamine or mercapto groups, and mixtures thereof, containing from 3 to 10 carbon atoms; n is an integer from 1 to 3; and X is a hydrolyzable group selected from the group consisting of Cl—, $OCH_3$, $OCH_2CH_5$, $OOCCH_3$, $OCH_2OCH_3$, amine, diamine, triamine, acyloxy and alkoxysilanes, and mixtures thereof.

2. The method of claim 1 wherein said adhesion promoter is applied to the electrolytically tin-plated steel strip in an amount so as to provide a coating of up to 0.5 milligrams per square meter of strip surface.

3. The method of claim 1 wherein said promoter is applied to said electrolytically tin-plated steel strip in one of (a) an organic oil lubricant solution applied to said strip on said strip processing line; (b) an aqueous solution applied to said strip on said strip processing line at one of (i) after reflowing of the electrolytic tin-plated coating and before a chemical passivation treatment, (ii) during chemical passivation treatment in, said aqueous solution comprising said organosilane and ions of a chemical passivation component, or (iii) after chemical passivation treatment; or a combination of (a) and (b).

4. The method of claim 3 wherein (b)(i) comprises applying said aqueous solution as a rinse after reflowing of the electrolytic tin-plated coating and before said chemical passivation treatment.

5. The method of claim 4 wherein (b)(iii) comprises applying said aqueous solution as a rinse after said chemical passivation treatment, said method including drying said strip after application of said aqueous solution before application of oil lubricant to the strip.

6. The method of claim 4 wherein in (b)(ii) said chemical passivation treatment comprises cathodic treatment with an aqueous dichromate solution and said promoter.

7. The method of 4 wherein the aqueous solution of (b)(i), (b)(ii) and (b)(iii) has a pH within the range of 4.0 to 6.0.

* * * * *